US005482825A

United States Patent [19]

Lok et al.

[11] Patent Number: 5,482,825

[45] Date of Patent: Jan. 9, 1996

[54] SILVER HALIDE EMULSIONS CONTAINING FUSED DIHYDROPYRIMIDINES

[75] Inventors: Roger Lok; Carl R. Preddy; Xin Wen, all of Rochester, N.Y.

[73] Assignee: Eastman Kodak Company, Rochester, N.Y.

[21] Appl. No.: 362,726

[22] Filed: Dec. 23, 1994

[51] Int. Cl.[6] ..... G03C 1/07; G03C 1/08; G03C 1/34

[52] U.S. Cl. ..... 430/567; 430/569; 430/600; 430/615

[58] Field of Search ..... 430/600, 615, 430/567, 569

[56] References Cited

U.S. PATENT DOCUMENTS

| | | | |
|---|---|---|---|
| 3,816,138 | 6/1974 | Öhlschläger et al. | 96/66.3 |
| 3,859,100 | 1/1975 | Kondo et al. | 430/600 |
| 3,893,862 | 7/1975 | Munshi et al. | 96/66.3 |
| 3,923,507 | 12/1975 | Öhlschläger et al. | 96/1.6 |
| 4,378,426 | 3/1983 | Lok et al. | 430/505 |
| 4,451,557 | 5/1984 | Lok et al. | 430/505 |
| 5,002,865 | 3/1991 | Kumashiro et al. | 430/600 |
| 5,264,338 | 11/1993 | Urabe et al. | 430/600 |

*Primary Examiner*—Lee C. Wright
*Attorney, Agent, or Firm*—Peter C. Cody

[57] ABSTRACT

A method of making a silver halide emulsion comprising precipitating and chemically sensitizing the emulsion and further comprising adding to the emulsion a fused dihydropyrimidine compound represented by the following formula:

(I)

wherein X is O, S or Se;

R is a substituted or unsubstituted alkyl or aryl group; and

Z contains the atoms necessary to form an aromatic group, a heteroaromatic group or a heterocyclic group and a silver halide emulsion made by this method.

22 Claims, 2 Drawing Sheets

SILVER HALIDE EMULSIONS CONTAINING FUSED DIHYDROPYRIMIDINES

FIELD OF THE INVENTION

The present invention relates to silver halide photographic elements containing fused dihydropyrimidines and a method of making same.

BACKGROUND OF THE INVENTION

Practical photographic emulsions are microcrystals of silver halide which are treated with certain chemicals to enhance their sensitivity to light. The photographic industry is engaged in continual efforts to modify the processes of making and sensitizing silver halide grains to obtain improved speed/fog relationships.

The manner in which iodide is introduced into silver halide grains has been shown to be important. The importance of the spatial relationship between halide phase boundaries and chemical treatment has also been described. It has also been recognized that photographic sensitivity can be increased by adjusting the pH and/or the pAg of the silver halide emulsion. It is also known that photographic speed can be enhanced by the addition of emulsion adjuvants such as alkyl ethers of polyethylene glycols; poly(thiodiethylene glutarate); azaindenes and mercaptoazoles. Certain reducing agents such as stannous chloride, ascorbic acid, dimethylamineborane have also been described as being useful to increase sensitivity. U.S. Pat. No. 3,893,862 describes the use 1,4- and 1,2-dihydropyridine compounds to increase effective speed upon development.

One problem which has been encountered in the development of highly sensitized emulsions is that of pressure desensitization. For example, emulsions containing grains exceeding 1 micron, particularly those having a tabular morphology and a halide phase structure designed for optimum light sensitivity, are strongly desensitized by the application of mechanical pressure to a coated film. Emulsions which have been sensitized by the introduction of localized regions of very high iodide content are particularly sensitive to mechanical pressure. Although emulsions can be designed which are highly resistant to this pressure induced desensitization, their light sensitivity is often inadequate to construct films with acceptable granularity.

Even with all the effort to develop highly sensitive emulsions, there is still a need for improved sensitizing agents, especially those which can be utilized over a wide range of pH and pAg without deleterious effects.

There is also a continuing effort in the industry to provide methods of modifying crystal habit to obtain crystal surfaces which differ from the conventional cubic and octahedral crystal faces. The reason for this is that the light absorption and stability of silver halide crystals is affected not only by the crystals' shape, but also by the different silver and halide ion distributions on the crystal faces which result in different surface electric fields. Further, photographically active materials such as dyes and chemical sensitizers absorb differently to different crystal faces thereby leading to more or less efficient latent-image formation.

It is thus a desire in the industry to provide new and alternative methods for modifying crystal growth. This will provide an opportunity to obtain silver halide crystals exhibiting advantageous characteristics such as high sensitivity and stability.

SUMMARY OF THE INVENTION

This invention pertains to a method of making a silver halide emulsion comprising precipitating and chemically sensitizing the emulsion and further comprising adding to the emulsion a fused dihydropyrimidine compound represented by the following formula:

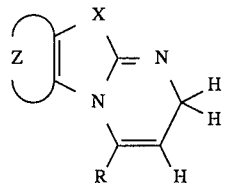

(I)

wherein X is O, S or Se;

R is a substituted or unsubstituted alkyl or aryl group; and

Z contains the atoms necessary to form an aromatic group, a heteroaromatic group or a heterocyclic group.

The invention also provides emulsions made by said method.

Emulsions containing the fused dihydropyrimidine compounds of this invention have enhanced photographic sensitivity. They are also resistant to pressure induced desensitization. This resistance can be obtained without a concurrent loss in sensitivity that is normally associated with emulsions exhibiting enhanced sensitivity. Additionally, the fused dihydropyrimidine compounds of this invention can be utilized to modify crystal morphologies during the growth of silver halide crystals.

DETAILED DESCRIPTION OF THE INVENTION

Figure 1:
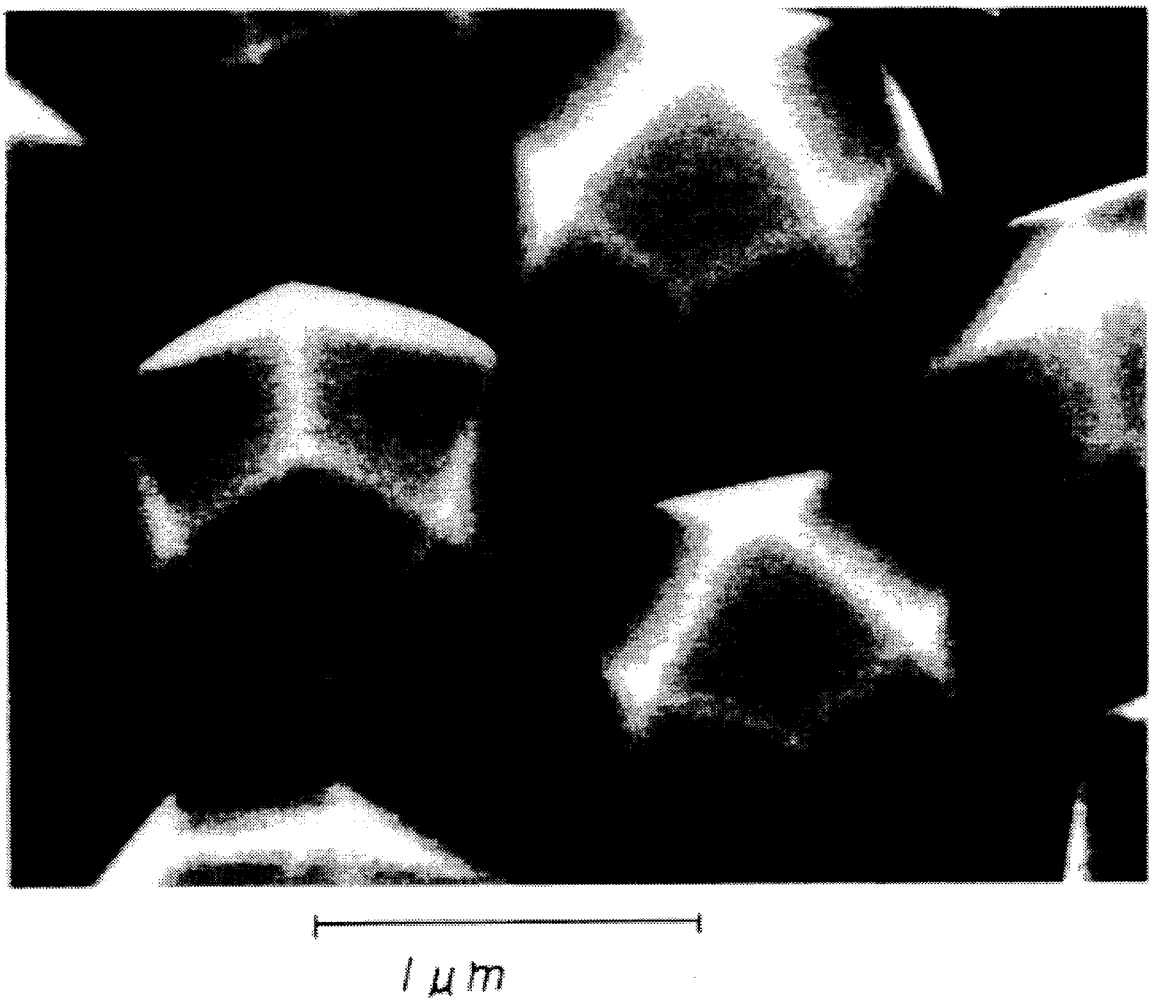
FIG. 1 depicts a scanning electron micrograph of silver halide crystals obtained from the overgrowth of a cubic seed emulsion prepared in the presence of Compound A at pH 6.5, 60° C., and pAg 6.7.
Figure 2:
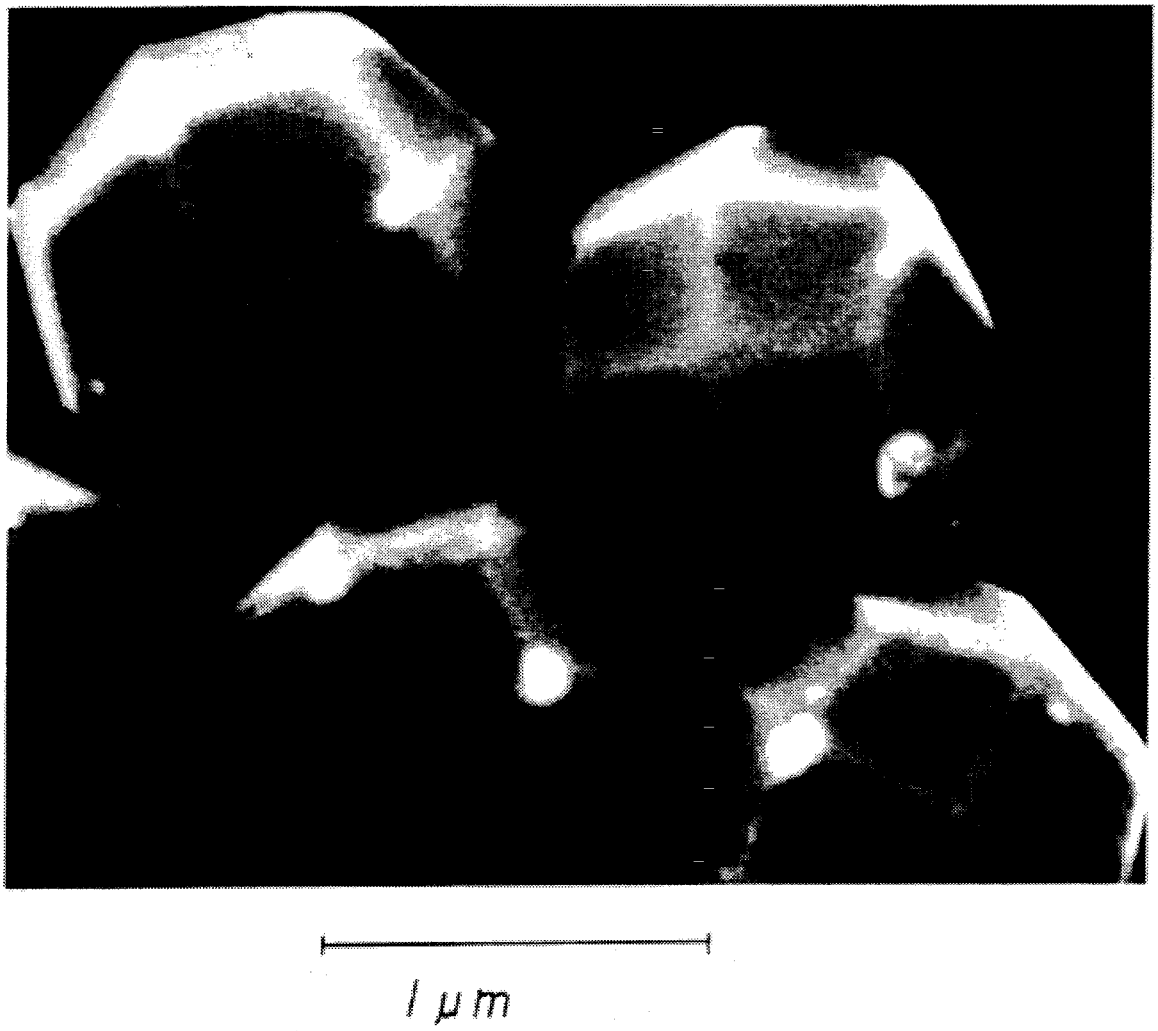
FIG. 2 depicts a scanning electron micrograph of silver halide crystals obtained from the overgrowth of a cubic seed emulsion prepared in the presence of Compound B at pH 6.5, 60° C., and pAg 6.7.

The fused dihydropyrimidine compounds of this invention are represented by the following formula:

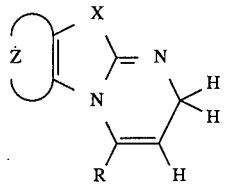

(I)

In the above formula, X may be O, S or Se, more preferably O. R may be an alkyl or aryl group, preferably an alkyl group. Preferably, the alkyl group contains 1 to 10 carbon atoms, with 1 to 4 being most preferred. The aryl group preferably contains 6 to 10 carbon atoms, with6 carbon atoms being most preferred.

Z contains the atoms necessary to form an aromatic group, a heteroaromatic group or a heterocyclic group. When Z forms an aromatic group, it may be either a single ring or a condensed ring, preferably having 6 to 10 carbon atoms, and more preferably, having 6 carbon atoms. Examples of suitable aromatic groups include phenyl, tolyl, naphthyl, and cycloheptatrienyl. When Z forms a heteroaromatic group it may be either a single ring or a condensed ring, preferably having 5 or 6 members. Examples of suitable heteroaromatic groups include pyrrole, pyridine, thiophene, quinoline, benzofuran, pyrazole, oxadiazole, thiadiazole, triazole, tetrazole, benzoxazole, benzothiazole, benzimidazole, or benzotriazole ring systems. Preferred heterocyclic groups are 5 or 6 membered heterocyclic rings, with O, N, or S being the preferred heteroatom. Examples of suitable heterocyclic groups are picoline, piperidine, morpholine, pyrrolidine, oxazolidine, thiazolidine, imidazolidine, tetrahydrofuran and tetramethylene sulfide. In the most preferred embodiment Z forms an aromatic group having 6 carbon atoms.

Z and R may be further substituted or may be unsubstituted. Examples of suitable substituents include alkyl groups (for example, methyl, ethyl, hexyl), fluoroalkyl groups (for example, trifluoromethyl), alkoxy groups (for example, triflouromethyl), alkoxy groups, (for example, methoxy, naphthyl, tolyl), hydroxy groups, halogen atoms, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxy groups, cyano groups, sulfo groups, and amino groups. Preferred are alkyl groups.

Examples of suitable fused dihydropyrimidines include the following compounds:

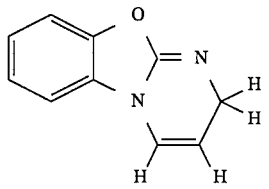
A

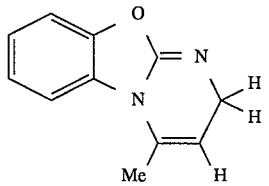
B

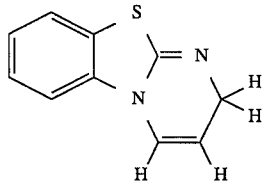
C

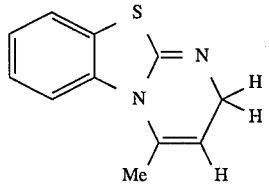
D

The photographic emulsions of this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are chemically and spectrally sensitized, by methods known in the art. Chemical sensitization of the emulsion employs sensitizers such as sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. Heat treatment is employed to complete chemical sensitization. Spectral sensitization is effected with a combination of dyes, typically cyanines designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating and extrusion coating.

For the purpose of sensitizing the emulsion or improving its resistence to pressure desensitization, the dihydropyrimidine compounds of this invention may be added to the silver halide emulsion at any time during the preparation of the emulsion, i.e., during precipitation, preferably during the latter half of grain growth, during or before chemical sensitization or during final melting and comixing of the emulsion and additives for coating. It is also contemplated that the compounds can be added to a coupler dispersion prior to its incorporation into the emulsion. When the dihydropyrimidine compounds are added to modify the growth characteristics of the emulsion they should be added before or during precipitation.

These compounds may be introduced by any means commonly practiced in the art such as by dissolving in a convenient organic solvent, or dispersed in a gelatin matrix. They may be added to the coupler melt which may be either dualed or combined with the emulsion melt during the coating process; to the vessel containing the aqueous gelatin salt solution before the start of the precipitation; or to a salt solution during precipitation. Other modes are also contemplated. The compounds can be added from the beginning or part-way-through precipitation. Temperature, stirring, addition rates and other precipitation factors may be set within conventional ranges, by means known in the art, so as to obtain the desired physical characteristics.

The optimal amount of the dihydropyrimidine compound will depend on the desired final result, the type of emulsion, the degree of ripening, the point of addition, the chemical structure, and other variables. A useful range of these compounds when used to improve sensitivity is from 0.6 to 6000 micromoles per mole silver. The preferred range is from 60 to 1500 micromoles per mole silver. When added during precipitation to obtain morphology modification, useful levels are between 1 and 1000 micromoles per mole silver and more preferably between 5 and 100 micromoles per mole silver.

Combinations of the dihydropyrimidine compounds of this invention may be used. The dihydropyrimidine compounds also may also be used in combination with other sensitizers, antifoggants and finish modifiers.

The dihydropyrimidine compounds of this invention may be utilized with any type of silver halide emulsion, for example silver bromide, silver iodobromide, silver iodochlorobromide, silver chlorobromide, and silver chloride. Preferably, though, the grains employed in the present invention are predominantly silver chloride or silver bromide. By predominantly silver chloride or silver bromide, it is meant that such grains are greater than 50 molar percent of the indicated silver halide. Preferably, the indicated silver halide accounts for greater than about 75 molar percent, and more preferably greater than about 85 molar percent. The grains may also contain iodide up to about 40 mole percent, although it is preferred that iodide content be less than about 25 mole percent. Iodide levels can vary in accordance with the amount of iodide soluble in a face centered cubic crystal lattice. For purely silver iodochloride grains, iodide content generally will not exceed about 13 mole percent; for purely silver iodobromide grains, iodide content generally will not exceed about 38 mole percent.

The emulsions may be conventional three-dimensional emulsions such as cubic, octahedral, or icositetrahedral, or they can be tabular grain emulsions. Ruffled and other irregular grains are also contemplated.

Examples of useful silver bromide and iodobromide tabular emulsions have a mean diameter greater than or equal to microns and a diameter/thickness ratio exceeding 7:1, with at least 50% of the projected area being contributed by such grains. The net iodide content may range from 0% to 20%. In a preferred embodiment, a solution of the dihydropyrimidine is introduced into the precipitation reactor during the latter half of grain growth.

The tabular grain emulsions generally are precipitated and washed according to conventional practices. The reactor is charged with a solution containing water, a peptizing agent, preferably bone gel, and a halide salt, typically NaBr. Optional ingredients may include, but are not limited to, strong mineral acids, certain polyalkylene oxide surfactants, and silver halide ripening agents, for example 1,8-dihydroxy- 3,6-dithiaoctane. Nucleation of AgBr or AgBrI by double-jet addition of a soluble silver salt and a halide salt mixture with vigorous mixing occurs at a temperature between 30° C. and 50° C., with a pH< 3.5, and a constant halide excess yielding a pAg of greater than 9.0 and less than 10.5. If used, iodide may be present at levels up to 20 mole percent. Ripening agent may be used at levels up to 0.5 mole per mole of silver nucleated. Iodide may be introduced by uniform incorporation, discontinuous introduction of an iodide-rich seed emulsion or soluble iodide salt, or by any combination of these methods. Following nucleation, additional peptizer can be added and reactor conditions adjusted to achieve a temperature from 40° C. to 80° C., a pH from 3.0 to 7.0, and a pAg from 8.0 to 9.0. AgBrI (0<%I<10%) can then be precipitated by double-jet addition of soluble silver salt and mixed halide solutions, using constant and/or accelerated flow profiles. The iodide fraction may vary anywhere within the stated range during the remainder of precipitation.

The photographic elements containing the emulsions of this invention can be non-chromogenic silver image forming elements. They can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whirmore U.S. Pat. No. 4,362,806 issued Dec. 7, 1982. The element can contain additional layers such as filter layers, interlayers, overcoat layers, subbing layers and the like. This invention may be particularly useful with those photographic elements containing a magnetic backing such as described in No. 34390, *Research Disclosure,* November, 1992.

In the following discussion of suitable materials for use in the emulsions and elements of this invention, reference will be made to *Research Disclosure,* December 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

The silver halide emulsions this invention can be either negative-working or positive-working. Examples of suitable emulsions and their preparation are described in Research Disclosure Sections I and II and the publications cited therein. Other suitable emulsions are (111) tabular silver chloride emulsions such as described in U.S. Pat. Nos. 5,176,991 (Jones et al); 5,176,992 (Maskasky et al); 5,178,997 (Maskasky); 5,178,998 (Maskasky et al); 5,183,732 (Maskasky); and 5,185,239 (Maskasky) and (100) tabular silver chloride emulsions such as described in EPO 534,395, published Mar. 31, 1993 (Brust et al). Some of the suitable vehicles for the emulsion layers and other layers of elements of this invention are described in Research Disclosure Section IX and the publications cited therein.

The silver halide emulsions can be chemically and spectrally sensitized in a variety of ways, examples of which are described in Sections III and IV of the Research Disclosure. The elements of this invention can include various dye-forming couplers including but not limited to those described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements containing the emulsions of this invention or individual layers thereof can contain, among other things, brighteners (Examples in Research Disclosure Section V), antifoggants and stabilizers (Examples in Research Disclosure Section VI), antistain agents and image dye stabilizers (Examples in Research Disclosure Section VII, paragraphs I and J), light absorbing and scattering materials (Examples in Research Disclosure Section VIII), hardeners (Examples in Research Disclosure Section X), plasticizers and lubricants (Examples in Research Disclosure Section XII), antistatic agents (Examples in Research Disclosure Section XIII), matting agents (Examples in Research Disclosure Section XVI) and development modifiers (Examples in Research Disclosure Section XXI).

The photographic elements can be coated on a variety of supports including but not limited to those described in Research Disclosure Section XVII and the references described therein.

Photographic elements can be exposed to actinic radiation, typically in the visible region of the spectrum, to form a latent image as described in Research Disclosure Section XVIII and then processed to form a visible dye image examples of which are described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable, and then developed with a color developer. Additionally, the preceding process can be employed but before uniformly fogging the emulsion the remaining silver halide is dissolved and the developed silver is converted back to silver halide; the conventional E-6 process is then continued and results in a negative color image. Alternatively, a direct positive emulsion can be employed to obtain a positive image.

Development is followed by the conventional steps of bleaching/fixing, or bleach-fixing, to remove silver and silver halide, washing and drying.

The following examples are intended to illustrate, without limiting, this invention.

EXAMPLES

Example 1

Preparation of Compounds A and B

A mixture of 2-(N-butynylamino)-benzoxazole (5.3 g, 0.03 mol) and silver tetrafluroborate (4 g, 0.02 mol) was stirred in 150 ml of acetonitrile at room temperature under dry nitrogen for one week. Sodium iodide (4 g, 0.027 mol) was added to the mixture which was stirred for another 15 minutes and then filtered. The filtrate was concentrated under vacuum, and the residue was slurried with cold, dry-ether and then filtered. The resulting tan solid weighed 3 g. It was sublimed at 125°–130° C. under 0.07 mm Hg of pressure. The sublimate had the correct structure of Compound B by NMR and elemental analysis.

Compound A was prepared by the same method except that 2-(N-propynylamino)-benzoxazole was used in place of the butynyl compound. Preparation of the inventive dihydropyrimidines generally follows the procedure described above for Compounds A and B.

Example 2

Emulsions in accordance with the present invention were prepared by dissolving Compounds A or B in methanol and adding them to an emulsion just prior to coating. The emulsion was a Au(I) and blue spectrally sensitized monodisperse cubic silver chloride negative emulsion containing yellow dye-forming coupler alpha-(4-(4-benzyloxy-phenylsulfonyl)phenoxy)-alpha(pivalyl)- 2-chloro-5-(gamma-(2,4-di-5-amylphenoxy)butyramido)acetanilide (1.08 g/m$^2$) in di-n-butylphthalate coupler solvent (0.27 g/m$^2$) and gelatin (1.51 g/m$^2$). In addition, 0.104 g of 1-(3-acetamidophenyl)-5-mercaptotetrazole and 1.033 g of potassium bromide per silver mole were added to the emulsion. The emulsion (0.34 g Ag/m$^2$) was coated on a resin coated paper support and 1.076 g/m$^2$ gel overcoat was applied as a protective layer along with the hardener bis (vinylsulfonyl) methyl ether in an amount of 1.8% of the total gelatin weight.

The coatings were given a 0.1 second exposure, using a 0–3 step tablet (0.15 increments) with a tungsten lamp designed to simulate a color negative print exposure source. This lamp had a color temperature of 3000 K, log lux 2.95, and the coatings were exposed through a combination of magenta and yellow filters, a 0.3 ND (Neutral Density), and a UV filter. The processing was a standard RA-4 color paper process and consisted of a color development (45 sec, 35° C.), bleach-fix (45 sec, 35° C.) and stabilization or water wash (90 sec, 35° C.) followed by drying (60 sec, 60° C).

The speed at 1.0 density units was taken as a measure of the sensitivity of the emulsion.

Table I illustrates the effects of Compound A and B of the present invention compared to the control which had no compound added. Clearly, both materials give speed increases over that of the control.

TABLE I

| Compound | mole (× 10$^3$) / Ag mole | Sample # | Speed |
|---|---|---|---|
| none | 0 (comparison) | 1 | 164 |
| A | 0.23 (invention) | 2 | 169 |
| A | 0.69 (invention) | 3 | 171 |
| B | 0.22 (invention) | 4 | 182 |
| B | 0.66 (invention) | 5 | 197 |

Example 3

The emulsion used in this example was the same as that used in Example 2, except that the chemical sensitizer used was sodium thiosulfate instead of the Au(I) compound. Compounds A and B were added to the emulsion as before. It can be seen in Table II that the inventive samples 7–10 show a clear speed increase over the control.

TABLE II

| Compound | mole (× 10$^3$) / Ag mole | Sample # | Speed |
|---|---|---|---|
| none | 0 (comparison) | 6 | 124 |
| A | 0.23 (invention) | 7 | 126 |
| A | 0.69 (invention) | 8 | 128 |
| B | 0.22 (invention) | 9 | 126 |
| B | 0.66 (invention) | 10 | 143 |

Example 4

Emulsions Y of this invention were prepared according to the following scheme. A reactor was charged with an aqueous solution containing a peptizing agent (bone gel), NaBr, nitric acid, a polyalkyleneoxide surfactant (Pluronic L43™), and 1,8-dihydroxy- 3,6-dithiaoctane. Nucleation of AgBr by double-jet addition of silver nitrate and sodium bromide with vigorous mixing occurred at constant temperature of 40° C., pH of 2.00, and pAg of 9.9. Following nucleation, additional peptizer was added and reactor conditions adjusted such that temperature was 70° C., and pH was 5.5. AgBrI at 3 mole % iodide was then precipitated by double-jet addition of soluble silver salt and mixed halide solutions, using constant and/or accelerated flow profiles of controlled, constant pAg of 8.9. The resulting tabular emulsions were isolated and purified according to conventional practices.

A control emulsion was prepared according to the above scheme, yielding tabular grains of median thickness 0.15 microns and equivalent circular diameter 2.7 microns. Experimental emulsions were prepared identically up to 95% of the total precipitated silver. At this point a solution of Compound A or B in a suitable solvent was added to the reaction mixture, which was then held at quiescent conditions for 5 minutes. Double-jet precipitation of AgBr was then resumed for the remaining 5% of the total silver halide. Physical dimensions and grain morphology of chemically treated emulsions were indistinguishable from those of the control.

The emulsions were subjected to identical sensitization sequences determined to give optimum speed/fog performance. The principal ingredients per mole of silver halide were: $1.2\times10^{-3}$ moles of benzoxazolocyanineblue sensitizing dye, $6.6\times10^{-6}$ moles of gold from a labile gold reagent, and $3.1\times 10^{-5}$ moles of sulfur from a labile sulfiding agent The sodium salt of 5-methyl-5-triazole-2,3-pyrimidine-7-ol was added for stabilizing the emulsion. The mixture of sensitized emulsion with a colloidal dispersion of a dye-forming coupler and additional gel was coated on a clear support with antihalation protection, in combination with a hardening agent and surfactants to obtain a high quality coating.

The comparison Emulsion X, $AgBr_{0.97}I_{0.03}$ had a tabular morphology and dimensions similar to control Emulsion Y except that the iodide was introduced by bulk addition of an iodide-rich seed emulsion during the latter half of crystal growth, and subsequently incorporated by recrystallization.

Dry coatings received a stepped exposure on a Type I-b sensitometer having a light source of color temperature 5500 K from which ultraviolet radiation was removed by means of a Wratten Type 2B filter in order to simulate illumination conditions within the blue layers of typical photographic films. The coatings were then processed through standard color reversal Process E-6 to yield a color-reversal dye image, or standard color negative Process C-41 to yield a negative dye image. Relative reversal speeds were measured as the difference in exposure required to reduce the maximum dye density by a fixed amount, or by other accepted algorithms for computing speed. Relative speed is expressed in units of 100*log (H) versus the control.

Pressure-induced desensitization was measured by comparing sensitometric curves with and without the application of mechanical pressure to the coated film by means of mechanical pinch rollers. A difference in exposure required to yield a fixed density (D=0.5) in the toe region of a reversal curve is a quantitative measure of desensitization, expressed as delta-speed (DEL-TOE).

The results in Table III show that sample 11, for which the emulsion was made with iodide introduced as an instantaneous dump of AgI seed emulsion, lost more than one stop in the reversal toe in the pressure test. This is an unacceptable loss of sensitivity for many applications. Sample 12, made with uniform iodide Emulsion Y but with no compound added, was little affected by pressure; but it suffered from a speed deficit. Samples 13 and 14, emulsions also made with uniform iodide distribution but with dihydropyrimidine Compounds A and B added during precipitation, had speed increases of about 0.2 log E with no significant effect on pressure desensitization response. The speed increase was comparable in both E-6 and C-41 processes. This demonstrates that Compounds A and B impart superior light sensitivity to the emulsions and that the improvement is not accompanied by increased susceptibility to desensitization induced by mechanical pressure applied to the coated films containing these emulsions.

TABLE III

| Sample # | Emulsion | Addendum | E-6 Speed | C-41 Speed | PRESSURE DEL-TOE |
|---|---|---|---|---|---|
| 11 | X | none | 133 | 129 | −40 |
| 12 | Y | none | 100 | 100 | +5 |
| 13 | Y | A | 118 | 115 | −3 |
| 14 | Y | B | 122 | 118 | +1 |

Example 5

This example illustrates the formation of icositetrahedral silver bromide emulsions using Compound A and a cubic AgBr seed emulsion prepared as follows. A AgBr cubic seed emulsion with 0.76-μm edge length was precipitated at pAg 5.8, pH 6.0, and 70° C. in oxidized gelatin. Four-tenths of a silver mol of the seed emulsion was added to a reaction vessel mounted with a motor-driven mixer. Five grams of oxidized gelatin were then added followed by distilled water to give a final weight of 450 g. A control precipitation was made in the absence of the compounds of the present invention, by overgrowing the cubic seed emulsion with 0.5 mol of 2.5 M $AgNO_3$ and 2.5 M NaBr solutions. The precipitation conditions were pH 6.5, 60° C., and pAg 6.7 for the cubic seed emulsion. Scanning Electron Microscope (SEM) examination showed that the cubic crystal habit was maintained throughout the control precipitation.

The growth-modifying effects of the dihydropyrimidine compounds were examined using the same precipitation conditions as the control precipitation. The pH and pAg in the reaction vessel containing the cubic seed emulsion were first adjusted to 6.5 and 6.7 respectively. A total of 1 mmol of Compound A was slowly added to the cubic seed emulsion in the reaction vessel. After the emulsion pH and pAg were readjusted back to the control values, the precipitation was started. Samples were drawn out of the emulsion at one quarter and one half of the overgrowth and at the end of the overgrowth. They were then examined by SEM. The grain morphology produced by adding Compound A can be seen in FIG. (1) as being icositetrahedral.

Example 6

This example illustrates the growth modification of silver bromide emulsions by Compound B using the same procedure as in Example 5. The emulsion morphology produced by adding Compound B can be seen in FIG. (2) as also being icositetrahedral.

While the invention has been described in detail and with reference to specific embodiments thereof, it will be apparent to one skilled in the art that various changes and modifications can be made therein without departing from the spirit and scope thereof.

What is claimed is:

1. A method of making a silver halide emulsion comprising precipitating and chemically sensitizing the emulsion and further comprising adding to the emulsion a fused dihydropyrimidine compound represented by the following formula:

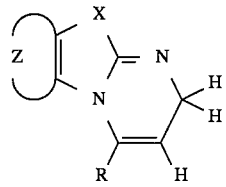

(I)

wherein X is O, S or Se;

R is a substituted or unsubstituted alkyl or aryl group; and

Z contains the atoms necessary to form an aromatic group, a heteroaromatic group or a heterocyclic group.

2. The method of claim 1 wherein R is an alkyl group having 1 to 10 carbon atoms or an aryl group having 6 to 10 carbon atoms; and Z contains the atoms necessary to form an aromatic group having 6 to 10 carbon atoms, a heteroaromatic group having at least one atom selected from O, or S, or a 5 or 6 membered heterocyclic ring having at least one atom selected from O, N, or S.

3. The method of claim 2 wherein Z is an aromatic group having 6 to 10 carbon atoms.

4. The method of claim 2 wherein R is an alkyl group having 1 to 4 carbons atoms or an aryl group having 6 carbon atoms.

5. The method of claim 3 wherein Z is an aromatic group having 6 to 10 carbon atoms.

6. The method of claim 5 wherein the fused dihydropyrimidine compound is added prior to or during precipitation.

7. The method of claim 6 wherein the silver halide emulsion is a predominantly silver bromide or silver chloride emulsion.

8. The method of claim 5 wherein the silver halide emulsion is a tabular emulsion.

9. The method of claim 1 wherein the silver halide emulsion is a predominantly silver bromide or silver chloride emulsion.

10. The method of claim 1 wherein the fused dihydropyrimidine compound is added prior to or during precipitation.

11. The method of claim 1 wherein the silver halide emulsion is a tabular emulsion.

12. A silver halide emulsion made by the method comprising precipitating and chemically sensitizing the emulsion and adding to the emulsion a fused dihydropyrimidine compound represented by the following formula:

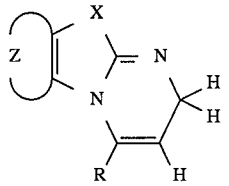

(I)

wherein X is O, S or Se;

R is a substituted or unsubstituted alkyl or aryl group; and

Z contains the atoms necessary to form an aromatic group, a heteroaromatic group or a heterocyclic group.

13. The emulsion of claim 12 wherein R is an alkyl group having 1 to 10 carbon atoms or an aryl group having 6 to 10 carbon atoms; and Z contains the atoms necessary to form an aromatic group having 6 to 10 carbon atoms, a heteroaromatic group having at least one atom selected from O, N or S, or a 5 or 6 membered heterocyclic ring having at least one atom selected from O, N, or S.

14. The emulsion of claim 13 wherein Z is an aromatic group having 6 to 10 carbon atoms.

15. The emulsion of claim 13 wherein R is an alkyl group having 1 to 4 carbons atoms or an aryl group having 6 carbon atoms.

16. The emulsion of claim 14 wherein Z is an aromatic group having 6 to 10 carbon atoms.

17. The emulsion of claim 16 wherein the fused dihydropyrimidine compound is added prior to or during precipitation.

18. The emulsion of claim 17 wherein the silver halide emulsion is a silver bromide emulsion.

19. The emulsion of claim 18 wherein the silver halide emulsion is a tabular emulsion.

20. The emulsion of claim 12 wherein the silver halide emulsion is a silver bromide emulsion.

21. The emulsion of claim 12 wherein the fused dihydropyrimidine compound is added prior to or during precipitation.

22. The emulsion of claim 12 wherein the silver halide emulsion is a tabular emulsion.

* * * * *